US006178800B1

(12) United States Patent
Edmonds et al.

(10) Patent No.: US 6,178,800 B1
(45) Date of Patent: Jan. 30, 2001

(54) ZONE HEATING METHODS AND APPARATUSES FOR METAL WORKPIECES FOR FORGING

(75) Inventors: Kevin Edmonds, Oxford; Jeffery Stenger, Otterlake, both of MI (US)

(73) Assignee: MSP Industries Corporation, Oxford, MI (US)

( * ) Notice: Under 35 U.S.C. 154(b), the term of this patent shall be extended for 0 days.

(21) Appl. No.: 09/114,970

(22) Filed: Jul. 14, 1998

(51) Int. Cl.[7] ..... B21J 1/06
(52) U.S. Cl. ..... 72/342.94; 72/364
(58) Field of Search ..... 72/342.1, 342.5, 72/342.6, 342.94, 364, 424; 219/154, 639, 655, 656; 470/17

(56) References Cited

U.S. PATENT DOCUMENTS 2,507,817 * 5/1950 Ropp et al. ..... 470/17
2,669,647 * 2/1954 Segsworth ..... 219/656
2,953,794 * 9/1960 Klooz ..... 72/364
3,007,181 * 11/1961 Felber ..... 72/424
3,885,411 * 5/1975 Szeliga ..... 72/342.1
4,222,260 * 9/1980 McDermott ..... 72/364

FOREIGN PATENT DOCUMENTS 58-25837 * 2/1983 (JP) ..... 72/342.94

* cited by examiner

*Primary Examiner*—Lowell A. Larson
(74) *Attorney, Agent, or Firm*—Oliff & Berridge, PLC

(57) ABSTRACT

Methods and apparatuses are disclosed for heating workpieces that are to be warm forged into parts having integral portions of different configurations, such as reduced portions and upset portions. The corresponding portions of the workpieces are heated to different temperatures in a zone heating apparatus such that the reduced portion is formed before the upset portion is formed when the part is formed from the workpiece in a single forging stroke of a forging press. The zone heating apparatus may include spaced heating coil assemblies, each having a heating coil. Workpieces are pushed through the heating assemblies of the zone heating apparatus in steps, with one portion of each workpiece undergoing more heating cycles than the other portion.

31 Claims, 13 Drawing Sheets

ZONE HEATING METHODS AND APPARATUSES FOR METAL WORKPIECES FOR FORGING

BACKGROUND OF THE INVENTION

1. Field of Invention

This invention is directed to methods and apparatuses for heating workpieces that are to be forged into metal parts. More particularly, this invention is directed to methods and apparatuses for heating workpieces (also known as billets, blanks or cuts) in such a way that different portions or "zones" of the workpieces are at different temperatures.

2. Description of Related Art

Many metal parts have distinct but integral portions that are of different configurations. An example is a part having a reduced portion at one end and an upset portion at the other end. Certain of these parts, including parts having reduced and upset end portions, must be manufactured, using present manufacturing processes and equipment, in separate and distinct steps-one step to form each distinct portion.

For example, it is known to form parts having a reduced portion at one end and an upset portion at the other end by first cold extruding a workpiece to form the reduced portion, and subsequently warm forging the workpiece to form the upset end. The reduced and upset end portions have not been formed by a single process, because (1) the upset end portion cannot be formed by cold extrusion and (2) both portions cannot be formed by a single warm forging stroke. As to the latter point, if a manufacturer attempted to manufacture such a part by a single warm forging stroke, the upset end of the workpiece would form first. Excessive tonnage (or compressive force) would then be exerted on the workpiece because the punch would be trying to force the already-upset workpiece into a reduced portion of the die cavity. This excessive force would result in underfilling of the reduced end portion (FIG. 6) of the part, while the upset end portion would have excess material or flash (FIG. 7).

It would obviously greatly increase productivity and reduce the cost of producing parts having distinct but integral portions of different configurations if the processing steps and/or equipment required to form the parts are reduced and/or simplified, e.g., if such parts can be produced in a single forging apparatus by a single forging stroke.

In this regard, parts having a flanged middle and concave recesses at the ends thereof have been produced in a single warm forging stroke by using a workpiece which has been heated such that its end portions have a temperature greater than the temperature of its center portion. However, certain parts having integral portions of other distinct and separate configurations cannot be formed by a single warm forging stroke using a workpiece which has been heated such that its end portions have a higher temperature than its middle portion, including parts having upset end portions and reduced end portions, as discussed above.

Accordingly, there is a need in the art for methods and apparatuses that enable manufacturers to form parts having integral portions of different configurations in a single process step using a single press.

SUMMARY OF THE INVENTION

This invention provides methods and apparatuses for heating workpieces that are to be formed into parts having integral portions of different configurations, such as upset ends and reduced ends. The workpieces are heated such that the portions of the workpieces which correspond to the portions of the parts having different configurations differ in temperature. Because the respective workpiece portions have different temperatures, these workpiece portions will deform in sequence during the warm forging process, i.e., the portion at the higher temperature will deform first. Thus, to form parts having upset portions and reduced portions, the portion of the workpiece corresponding to the reduced portion of the finished part can be heated to a higher temperature, and that portion of the workpiece will deform first (forming the reduced portion first). This substantially eliminates the problem of underfill on the reduced portion and flash on the upset portion as discussed above.

Certain embodiments of this invention include a plurality of heating assemblies. The workpieces are advanced through the heating assemblies in a series of discrete steps, or increments, i.e., each workpiece is in a first position for a set period of time, then moved to a second position for the set period of time, etc. The heating assemblies are spaced and located such that one portion of the workpiece is in one heating assembly and the other portion of the workpiece is either in another heating assembly or is not in any heating assembly during each step or increment. Further, one portion of each workpiece is exposed to N heating steps, while the other portion is exposed to M heating steps, where $M<N$, such that the first portion is at a higher temperature than the second portion.

In certain embodiments of this invention, a workpiece holding assembly is provided to periodically engage and retain the workpieces in a desired position relative to the heating assemblies. This workpiece holding assembly may include a clamping finger assembly including at least one clamping finger, and may be activated by a pneumatic cylinder.

Some embodiments of this invention include a pusher assembly which advances the workpieces through the heating assemblies. The pusher assembly may be activated by, for example, a pneumatic cylinder. Preferably, the operation of the workpiece holding assembly is synchronized with the activation of the pusher assembly such that the clamping finger assembly of the workpiece holding assembly is raised when a workpiece is being moved by the pusher assembly and is lowered into a clamping position when the workpiece stops.

BRIEF DESCRIPTION OF THE DRAWINGS

Certain preferred embodiments of this invention will be described in detail, with reference to the following figures, in which.

DETAILED DESCRIPTION OF PREFERRED EMBODIMENTS

This invention is directed to methods and apparatuses for heating workpieces to be warn forged into parts, such that the workpieces have portions or "zones" at different temperatures. These workpieces having zones at different temperatures can be formed, in a single process step or forging cycle, into parts having integral portions of different configurations.

Figure 1:
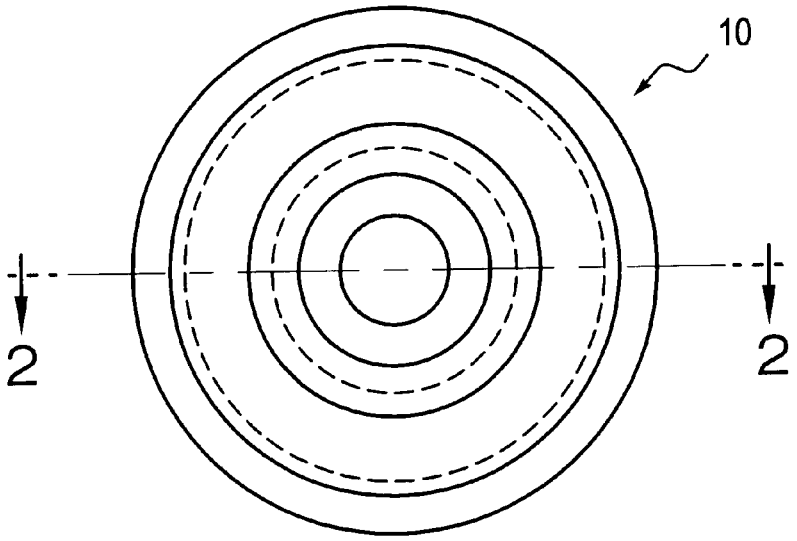
FIG. 1 is a top view of a part having an upset end and a reduced end which can be produced by certain embodiments of this invention.
Figure 2:
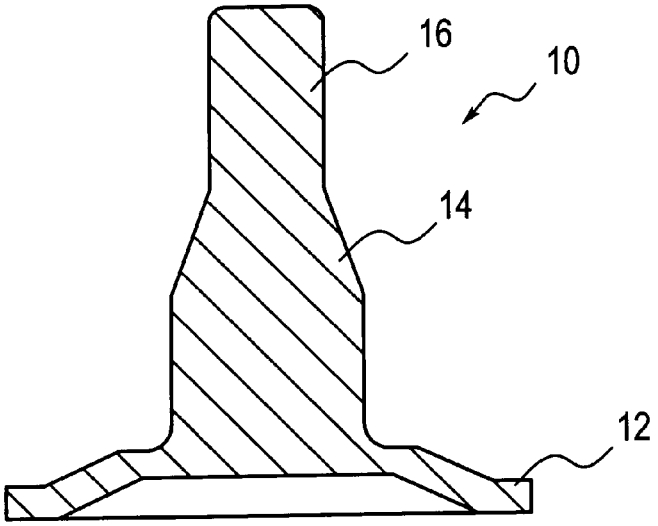
FIG. 2 is a cross sectional view along line 2—2 of FIG. 1.
Figure 3:
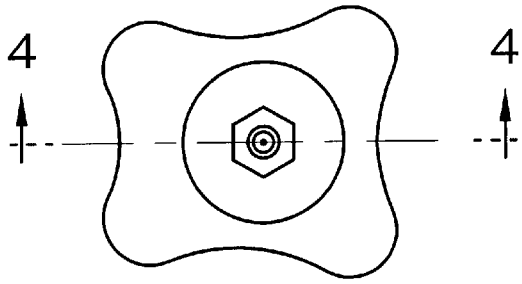
FIG. 3 is a top view of another part which can be produced by certain embodiments of this invention.
Figure 4:
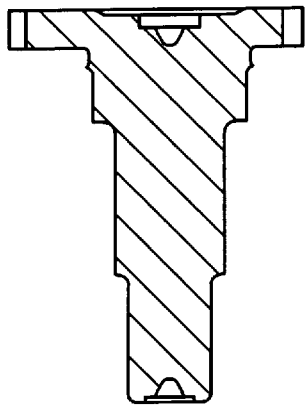
FIG. 4 is a cross sectional view along line 4—4 of FIG. 3.
Figure 5:
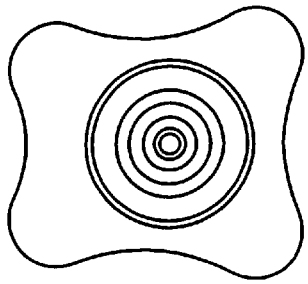
FIG. 5 is a bottom view of the part shown in FIGS. 3 and 4.

FIGS. 1 and 2 show an example of a part having integral portions of different configurations that may be warm forged in a single stroke or cycle using a workpiece which has been heated using the zone heating methods and apparatuses of this invention. The part 10 has an upset end portion, in the form of a flange 12, and a reduced end portion 16. The flange 12 and the reduced end portion 16 are connected by a transition portion 14.

Figure 9:
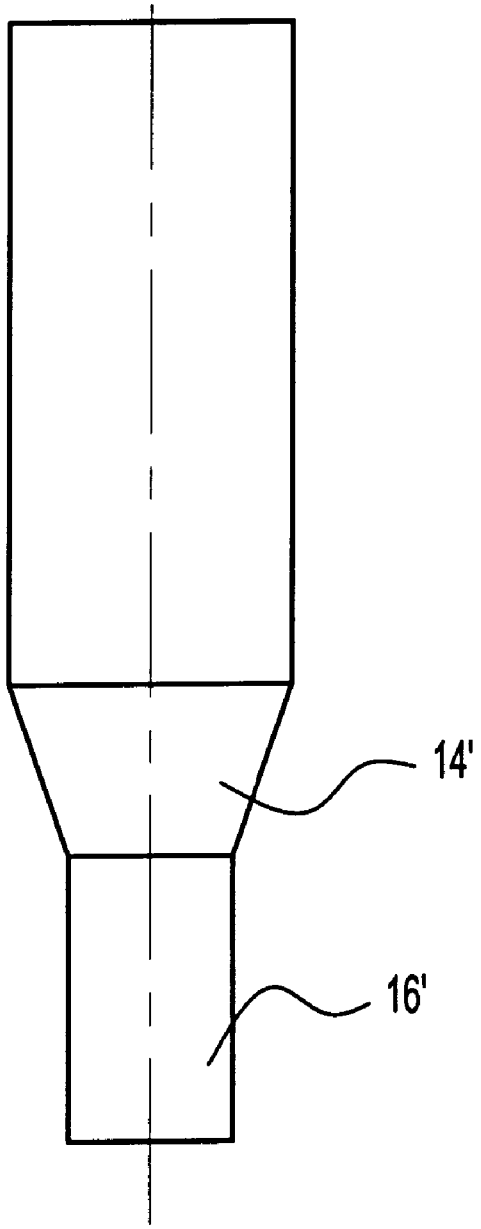
Fig. 9 Prior Art
FIG. 9 is a side view of a workpiece such as the workpiece of FIG. 8, illustrating the workpiece after it has been through a cold extrusion processing step.

Prior to this invention, certain metal parts having integral portions of different configurations, such as part 10, had to be produced or formed by multiple processing steps. For example, parts such as part 10 were formed by first cold/warm extruding a workpiece into the shape shown in FIG. 9, thus forming an extruded portion 16' and a transition portion 14'. This intermediate-stage workpiece was then uniformly heated and placed in a toolset within a forging press.

Figure 6:
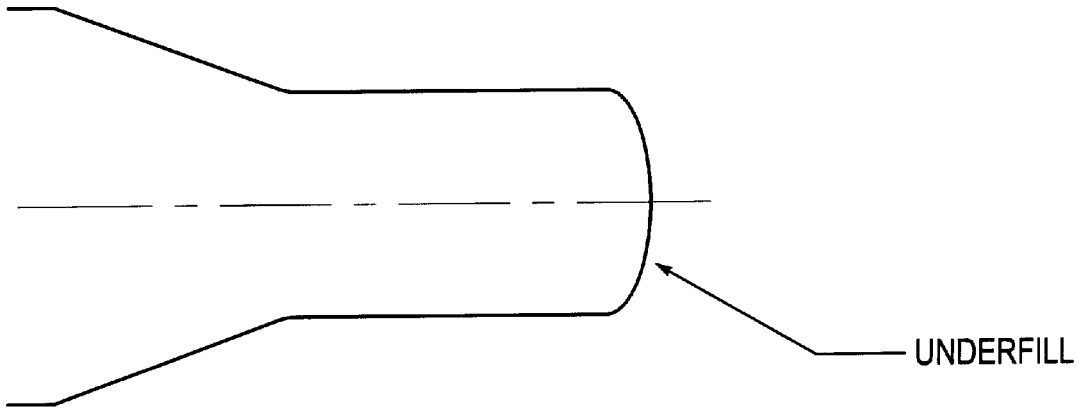
FIG. 6 shows an enlarged view of underfill on the reduced portion.
Figure 7:
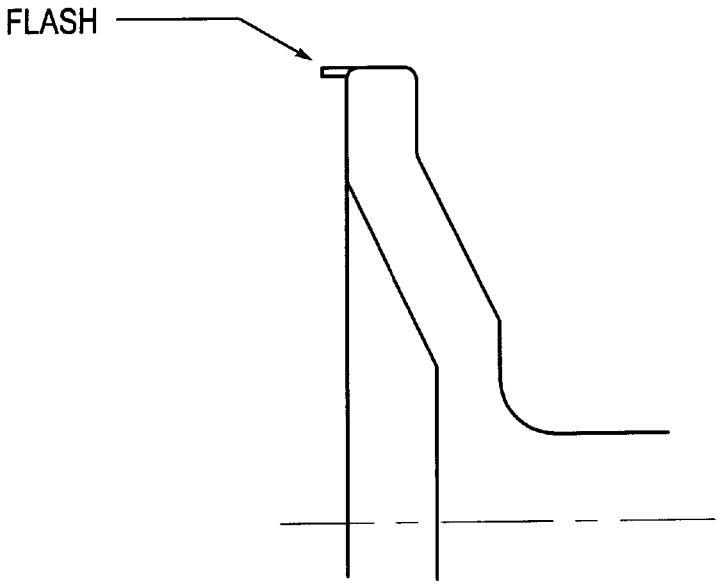
FIG. 7 shows an enlarged view of flash on the upset portion.
Figure 8:
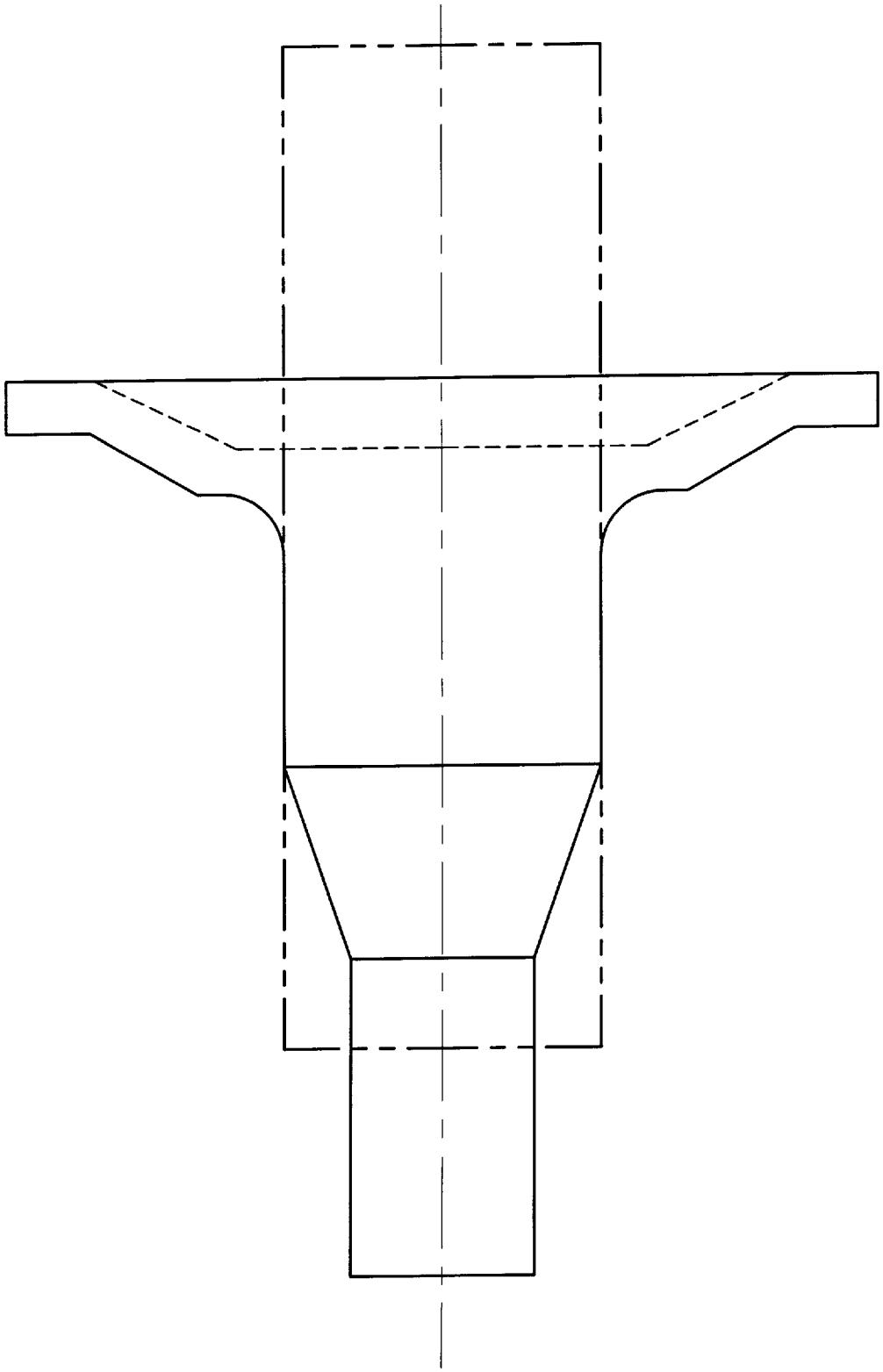
FIG. 8 shows a part having an upset end and a reduced end, overlaid by an outline of a workpiece from which the part may be formed.

The forging press was then cycled through a forging stroke or cycle to form the flange 12. Thus, separate operations on separate machines were required to form the part 10 from the initial workpiece. This two step process had to be conducted because flange 12 cannot be effectively formed by cold forming, and if one attempts to manufacture part 10 by a single warm forging stroke, the effect would be flash (FIG. 7) and underfill (FIG. 6).

One embodiment of the apparatuses of this invention is illustrated in FIGS. 15–18B, zone heating apparatus 100. The zone heating apparatus 100 includes a cart 40 (having wheels 42), heating coil assemblies $H_1$–$H_5$, a pneumatic cylinder 36, dummy coil assemblies 30, a tray 39 and a holder 50. The zone heating apparatus 100 is designed to receive and zone heat cylindrical workpieces, such as workpiece 10' (see FIG. 10).

The heating coil assemblies $H_1$–$H_5$ are secured to the cart 40 in a spaced row, with heating coil assemblies $H_1$–$H_5$ being in alignment. In this embodiment, heating coil assemblies $H_{1-H5}$ include inductive heating coils 20, 20 and/or 20" encased in an insulating material, for example, cement or mortar. In other embodiments, radiant, conductive or convective heating devices may be used instead of the heating coil assemblies $H_1$–$H_5$.

FIGS. 12A–14B show various embodiments of the heating coil assemblies $H_1$–$H_5$. Each of these heating coil assemblies includes a coil 20, 20' or 20" (having loops 22, 22' or 22") encased in a coil box 26, 26' or 26". Exposed end portions 24,24' or 24" of the coils 20, 20' or 20" protrude from the coil boxes 26, 26' or 26", respectively.

Figure 12B:
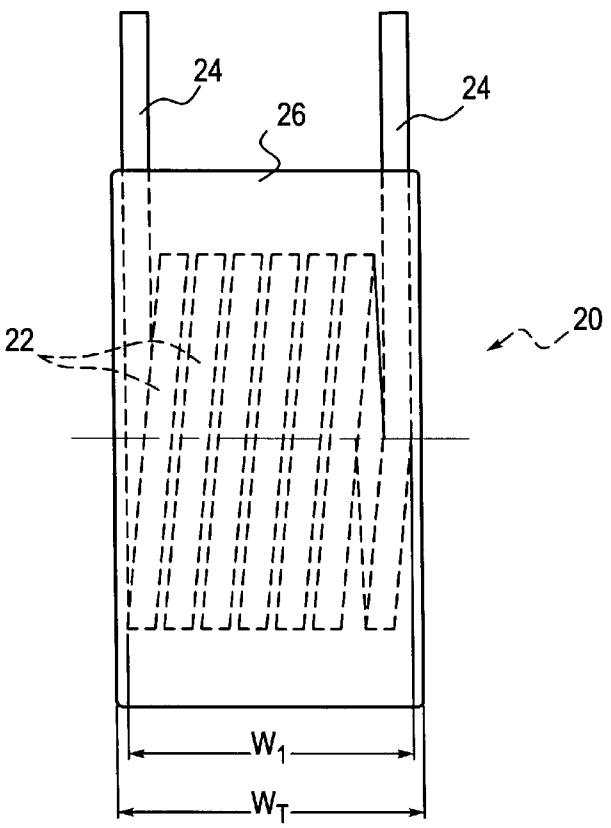
FIG. 12B is a side view of the heating coil box of FIG. 12A.
Figure 12A:
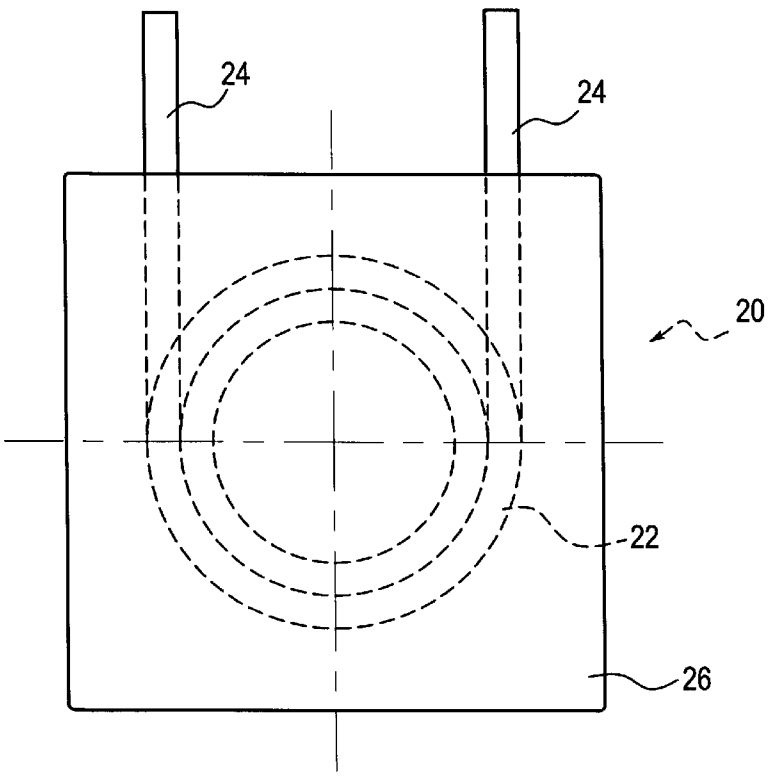
FIG. 12A is an end view of a heating coil box according to one embodiment of this invention.
Figure 13B:
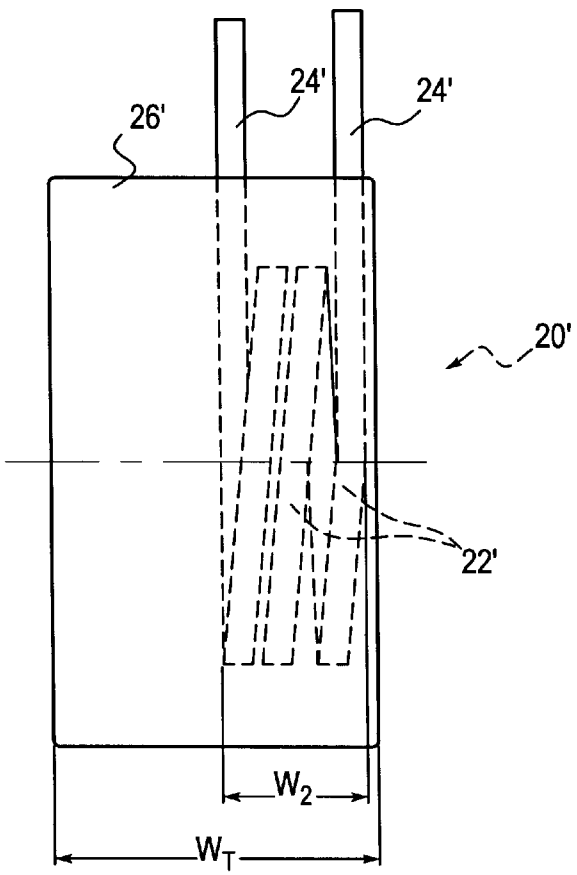
FIG. 13B is a side view of the heating coil box of FIG. 13A.
Figure 13A:
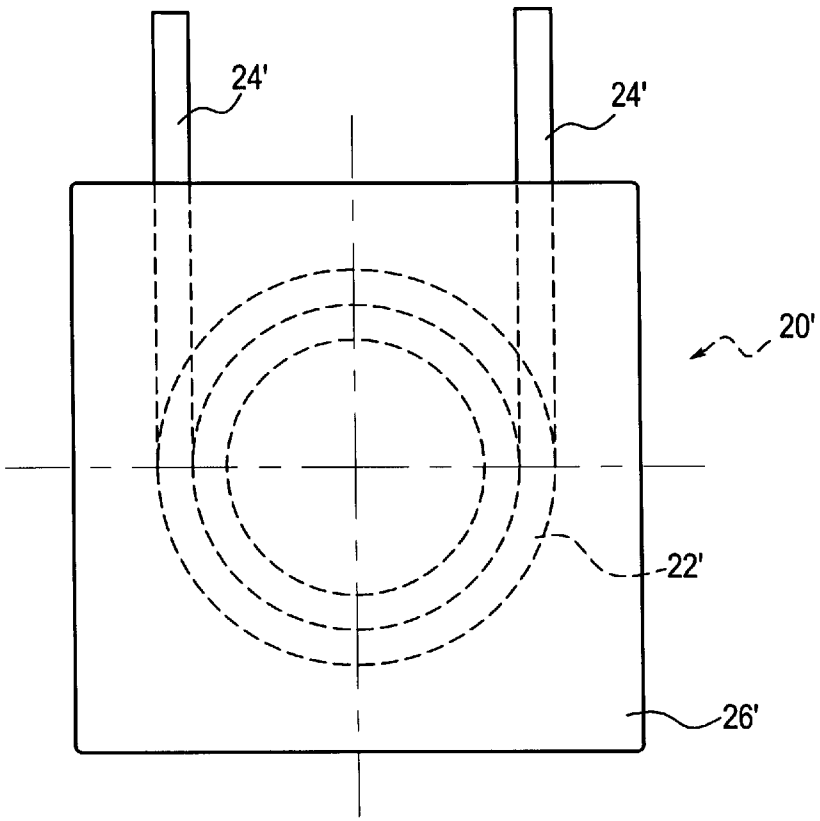
FIG. 13A is an end view of a heating coil box according to another embodiment of this invention.
Figure 14B:
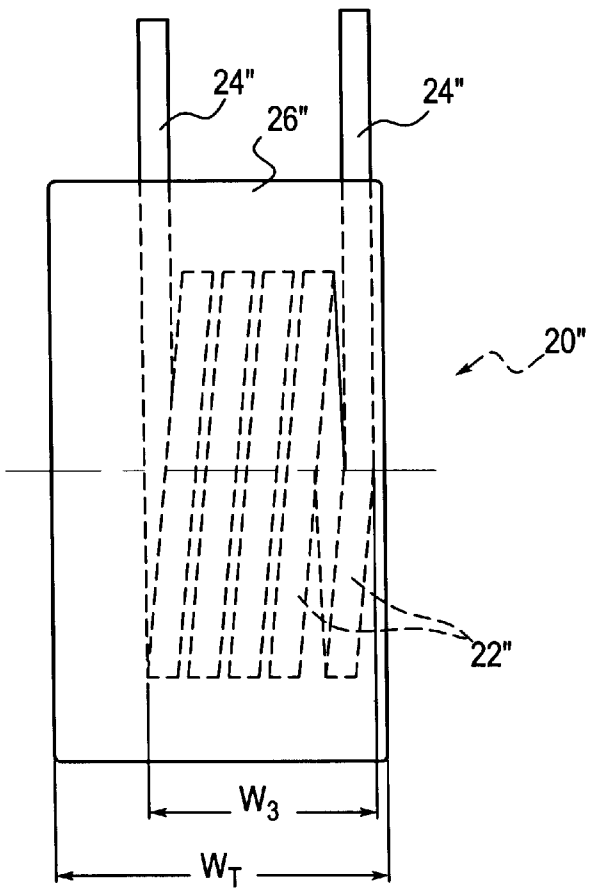
FIG. 14B is a side view of the heating coil box of FIG. 14A.
Figure 14A:
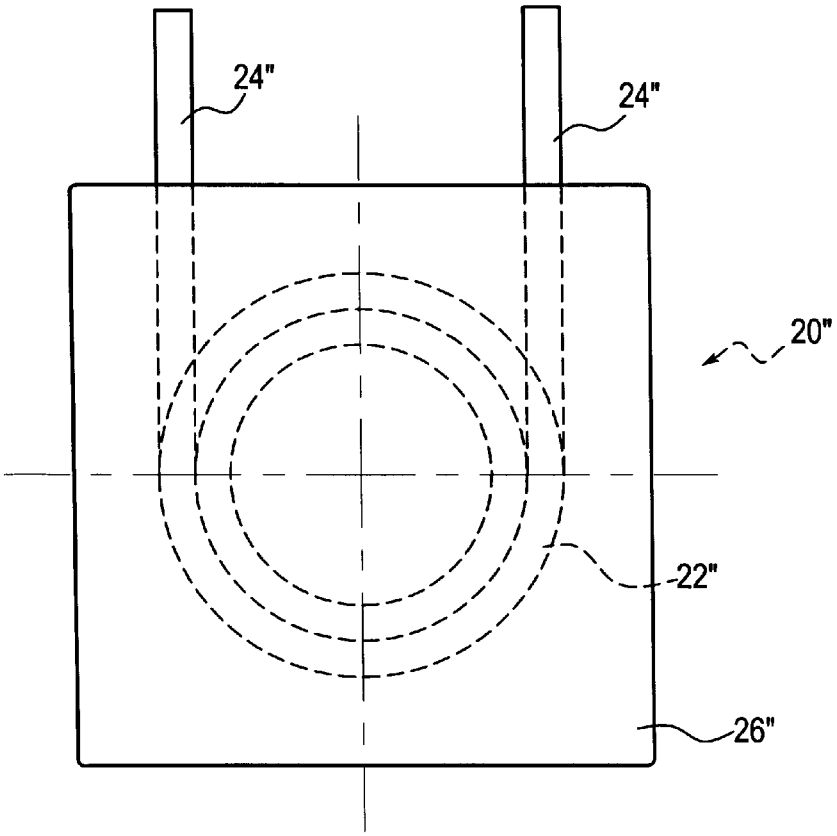
FIG. 14A is an end view of a heating coil box according to yet another embodiment of this invention.

In the coil box 26 shown in FIGS. 12A and 12B, the coil loops 22 are disposed over a width $W_1$ of the coil box 26. The width $W_1$ is almost as long as the overall width $W_T$ of the coil box 26.

In the coil boxes 26' and 26" shown in FIGS. 13A–14B, the widths $W_2$ and $W_3$ of coils 20' and 20", respectively, are significantly less than the overall width $W_T$. Accordingly, these coil boxes 26' and 26" heat over shorter lengths than the coil box 26 of FIGS. 12A–12B.

Since these coils 20, 20' and 20" (having different heating coil configurations) are provided in coil boxes 26, 26' and 26" of equal width, they can be interchangeably arranged in any desired order and/or combination to form a row of coil boxes, without having to adjust the spacing between adjacent boxes. In other words, coil boxes with differing coil configurations and widths, or coil boxes with similar coil configurations, can be arranged in a spaced row to provide any desired heating pattern.

Further, coil boxes 26, 26' and 26" are intended as examples only. The coil boxes employed in the apparatuses and methods of this invention can be of any configuration, and have any number of coil loops, as space permits.

In order to efficiently concentrate the heating action of each heating coil 20, 20' and 20" onto the desired or target heating area or areas of each workpiece, the coils 20, 20' and 20" have relatively small diameters. For example, in this embodiment, the workpiece has a diameter of from about 1.900 inches to about 2.000 inches, the coils have an inside diameter of about 4.000 inches, and the coil boxes have a passage with a diameter of about 3.125 inches.

Additionally, in order to more uniformly heat the workpieces, the coils 20, 20' and 20" preferably have square cross sections. Square copper tubing is particularly effective and heat- and energy-efficient. More specifically, in the embodiments illustrated in the Figures, the use of square copper tubing having a width of about ⅜" is effective and energy-efficient when heating workpieces 10, although it is obvious that similar results may be obtained if smaller or larger square copper tubing is used, or if a coil that has a solid rectangular cross section is used. Coils having other polygonal cross sections, or round or oval cross sections, can also be employed.

Further, while this embodiment of the invention has five heating assemblies, other embodiments may include more or less than five heating assemblies. In fact, certain embodiments may have a single heating assembly in which only one end of the workpieces is heated. The other end of the workpieces would be gradually heated by conduction. Alternatively, the various heating assemblies of a specific array of heating assemblies can be designed to heat the workpieces different temperatures. Thus, an embodiment having two heating assemblies can be employed, and the workpieces could be individually positioned with their opposite ends positioned respectively in each assembly and heated simultaneously to different temperatures.

Furthermore, although in the above-described embodiments the heating coil assemblies are provided in separate coil boxes, other embodiments may provide more than one heating coil assembly in a single coil box.

Dummy coil assemblies 30 are also secured to the cart 40 and are provided to balance the electrical load on the electrical system of zone heating apparatus 100, as needed. Dummy coil assemblies 30 are electrically connected in series to the heating coil assemblies $H_1$–$H_5$.

Some embodiments of this invention do not include any dummy coil assemblies such as dummy coil assemblies 30. The inclusion of the dummy coil assemblies depends on the electrical "imbalance" caused by the heating coil assemblies of a particular embodiment.

The tray 39 is attached to the cart 40 and is positioned such that it extends from at least a workpiece length in front of heating coil assembly $H_1$, through heating coil assemblies $H_1$–$H_5$, and at least a distance beyond the last heating coil assembly $H_5$ sufficient that a workpiece 10' can be removed from the tray 39 by tongs; i.e., such that a workpiece 10' can be removed from the position $P_f$.

Figure 16:
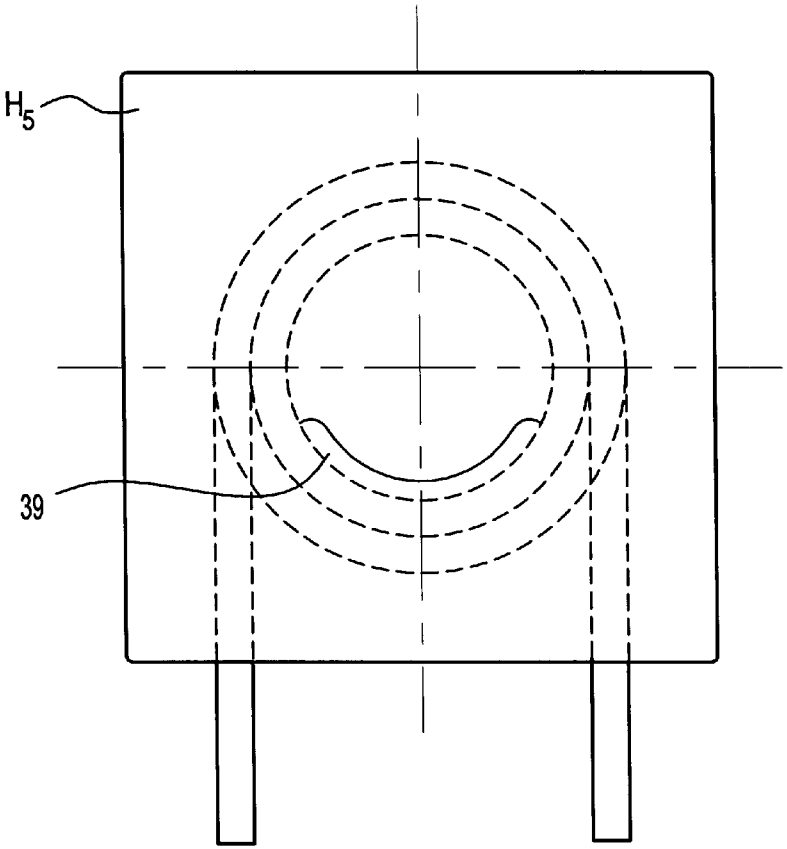
FIG. 16 is a partial end view of the assembly of heating coil boxes shown in FIG. 15.

As shown in FIG. 16, the tray 39 is made, for example, of stainless steel and has a cross-sectional shape (such as the arcuate shape shown in FIG. 16) which (1) supports and laterally retains workpieces 10' and (2) permits workpieces 10' to slide along it in the longitudinal direction.

The pneumatic cylinder 36 is attached to the cart 40 and is located such that its reciprocal rod 37 is substantially in alignment with the center line of the workpieces 10' when the workpieces 10' are properly placed on the tray 39. The reciprocal rod 37 has a workpiece contact member 38 at its distal end. The workpiece contact member 38 engages and pushes workpieces 10' through the heating coil assemblies $H_1$–$H_5$ when the pneumatic cylinder 36 is activated. The pneumatic cylinder 36 is activated, for example, about every 9–10 seconds. The reciprocal rod 37 extends a distance such that the workpieces 10' are advanced in steps or increments substantially equal to the length of a workpiece 10'.

Figure 15:
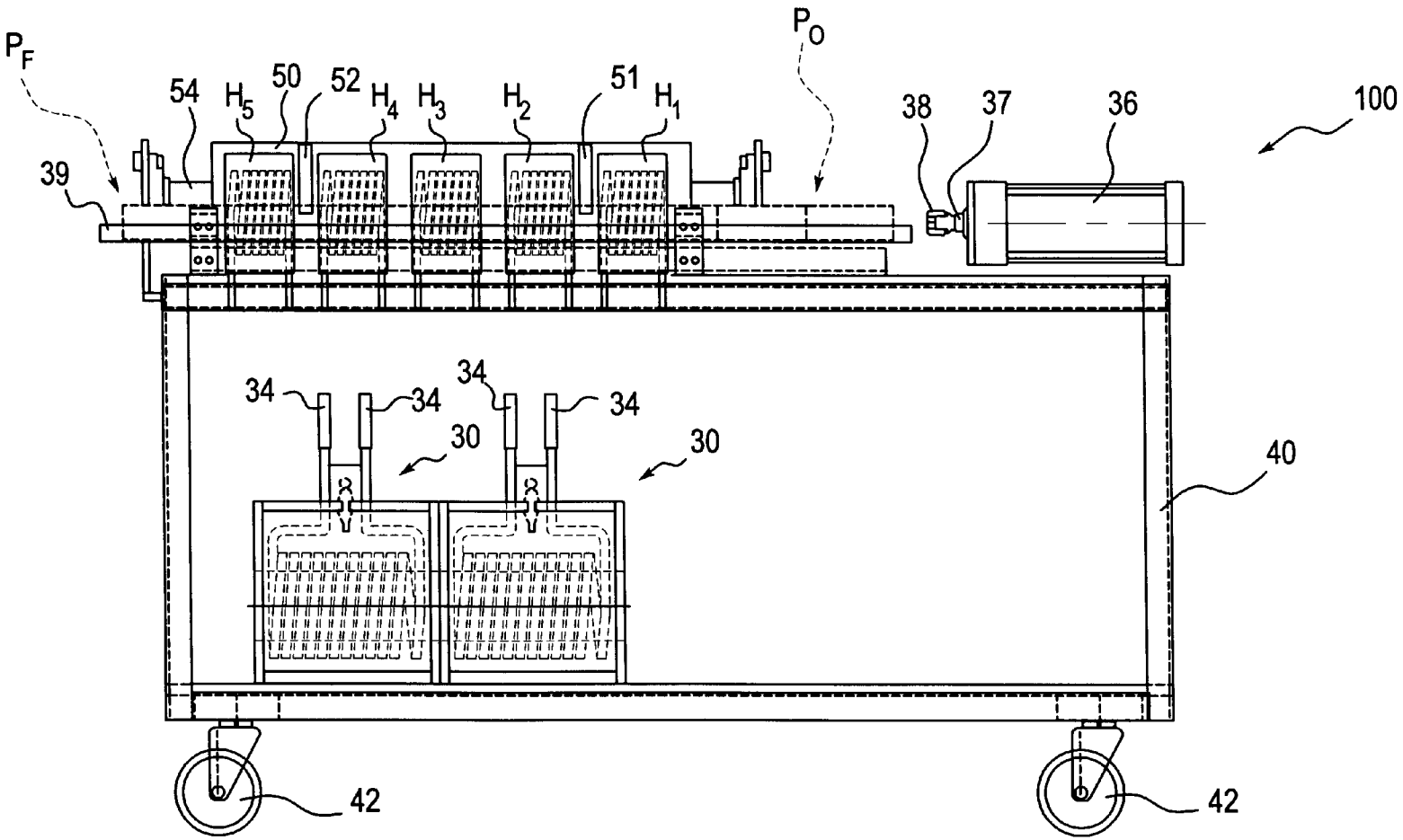
FIG. 15 shows an assembled zone heating apparatus according to one embodiment of this invention.

Specifically, at rest, the reciprocal rod 37 is in the retracted position, illustrated in FIG. 15. When the pneumatic cylinder 36 is activated, the rod 37 extends outwardly the desired distance, pushing the row of workpieces 10' through the heating coil assemblies $H_1$–$H_5$ a distance equal to the length of workpiece 10'. Rod 37 then retracts. The row of workpieces 10' is advanced a distance substantially equal to the length of a workpiece 10' each time pneumatic cylinder 36 is activated. Each such cycle may take, for example, about two seconds.

This cycle is repeated to cycle a series of the workpieces 10' through the heating coil assemblies $H_1$–$H_5$, as discussed in detail below. In summary, a workpiece 10' is placed in the position $P_0$ as shown in FIG. 15. The pneumatic cylinder 36 is activated, extending the reciprocal rod 37 outwardly. The workpiece contact member 38 contacts and pushes the workpiece 10' that is initially in position $P_o$ to the left to position $P_x$. The reciprocal rod 37 of the pneumatic cylinder 36 is retracted and the next workpiece 10' may be placed at the position $P_o$. This cycle is repeated to move the workpieces through the heating coil assemblies $H_1$–$H_5$.

As stated, the row of workpieces 10' slide along the tray 39 as the workpieces 10' are pushed as described above. When a workpiece 10' reaches the position $P_f$ shown at the left of FIG. 15, the leading end of the workpiece 10' protrudes from heating coil assembly $H_5$. The workpiece 10' may then be immediately grabbed with tongs (not shown), for example, and placed in a forging press, such as the forging press 60 of FIG. 6, to be forged. Thus, the trailing end of each workpiece 10' is not heated in heating coil assembly $H_5$, and is thus cooler than the leading end, which undergoes heating in all five heating coil assemblies $H_1$–$H_5$, as described below.

Figure 18B:
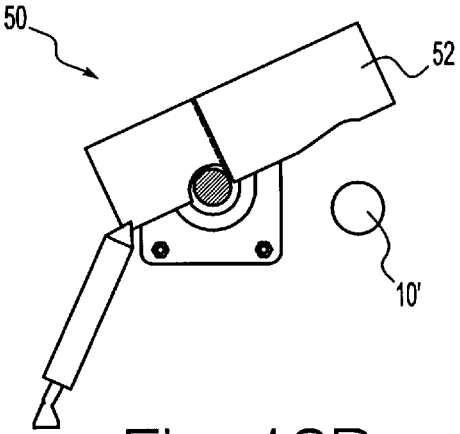
FIG. 18B shows the workpiece holding assembly of FIG. 17 in a raised position.
Figure 17:
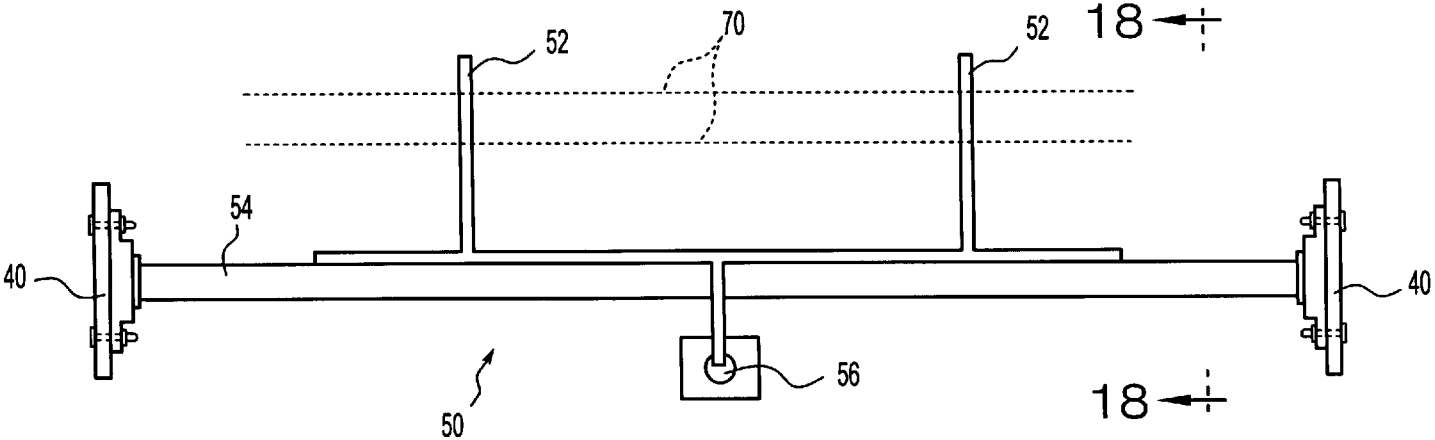
FIG. 17 is a top view of a workpiece holding assembly according to one embodiment of this invention.

A workpiece holding assembly 50 is also attached to the cart 40, and includes a shaft 54, a finger assembly 52 and a pneumatic cylinder assembly 56 (see FIGS. 17–18B). The shaft 54 is rotatably attached to the cart 40. The finger assembly 52 is fixedly mounted on the shaft 54. The pneumatic cylinder assembly 56 extends between the cart 40 and the finger assembly 52. In FIG. 17, the dashed lines 70 show the path of the workpieces 10' with respect to the workpiece holding assembly 50.

Figure 18A:
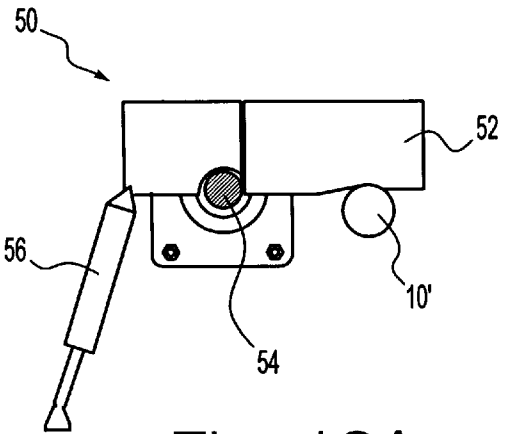
FIG. 18A shows the workpiece holding assembly of FIG. 17 in a clamping position.

When the pneumatic cylinder assembly 56 is not activated, the fingers of the finger assembly 52 are in engagement with the workpieces 10' (see FIG. 18A). When the pneumatic cylinder assembly 56 is activated, the shaft 54 and the finger assembly 52 rotate until the finger assembly 52 disengages the workpieces 10' (see FIG. 18B). FIG. 18B). In the lowered position (FIG. 18A), or clamping position, the finger assembly 52 presses downward against workpieces 10' and retains workpieces 10' in place.

In this embodiment, the finger assembly 52 includes two fingers which are positioned laterally along the shaft 54. The first finger is between heating coil assemblies $H_1$ and $H_2$, and the second finger is between heating coil assemblies $H_4$ and $H_5$. The finger assembly 52 may include as many fingers as desired, and the fingers can be located at any location where contact with the row of the workpieces is possible.

The fingers of the finger assembly 52 may be spring-biased. This obviates the need for precise calibration of the activating assembly and automatically compensates for any wear of the fingers of the finger assembly 52.

The finger assembly 52 performs the following function. When electricity is passing through the heating coils 20, 20' and/or 20" in order to inductively heat the workpieces 10', a magnetic field is induced in the coils. This magnetic field creates a force tending to pull the workpieces 10' through the coil boxes 26, 26' and/or 26". The workpiece holding assembly 50 opposes this force, by retaining the workpieces 10' in place when the workpiece holding assembly 50 engages the workpieces 10' .

The activation of the pneumatic cylinder assembly 56, and thus of the finger assembly 52, is sequenced with the activation of the pneumatic cylinder 36. Specifically, in this embodiment, the pneumatic cylinder assembly 56 and pneumatic cylinder 36 are sequenced such that when the finger assembly 52 is raised, the pneumatic cylinder 36 is activated, thereby advancing the workpieces 10'. After the workpieces 10' have been advanced by the pneumatic cylinder 36, the finger assembly 52 is lowered to retain the workpieces 10' in position for the desired time period.

The method of heating the workpieces 10' using the zone heating apparatus 100 will now be described. A workpiece 10' is inserted in the tray 39 at approximately the position $P_o$ (see FIG. 15), with the rod 37 of the pneumatic cylinder 36 in the retracted position. With the pneumatic cylinder assembly 56 not activated, and thus with the finger assembly 52 in the up position (not engaging workpieces 10'), the pneumatic cylinder 36 is activated. This causes the rod 37 of pneumatic cylinder 36 to extend, and the workpiece engagement member 38 engages the workpiece 10' and pushes it one workpiece length towards the heating coil assemblies $H_1$–$H_5$, to position $P_x$ (in this embodiment).

After the workpiece 10' has been moved to position $P_x$, the pneumatic cylinder assembly 56 is activated, rotating the finger assembly 52 to its down position, such that the fingers engage the row of workpieces 10' (as shown in FIG. 18A). After a predetermined time, the pneumatic cylinder assembly 56 is deactivated, retracting the fingers of the finger assembly 52 away from the workpieces 10'.

Meanwhile, a next workpiece 10' is inserted in position $P_o$. The above process is repeated, moving the workpiece 10' which is now in position $P_o$ to $P_x$, the workpiece 10' in $P_x$ to $P_1$, to workpiece 10' in $P_1$ to $P_2$, etc. In this manner, a plurality of workpieces 10' is advanced in steps or increments through the heating coil assemblies $H_1$–$H_5$ in the direction indicated by arrow R.

Figure 10:
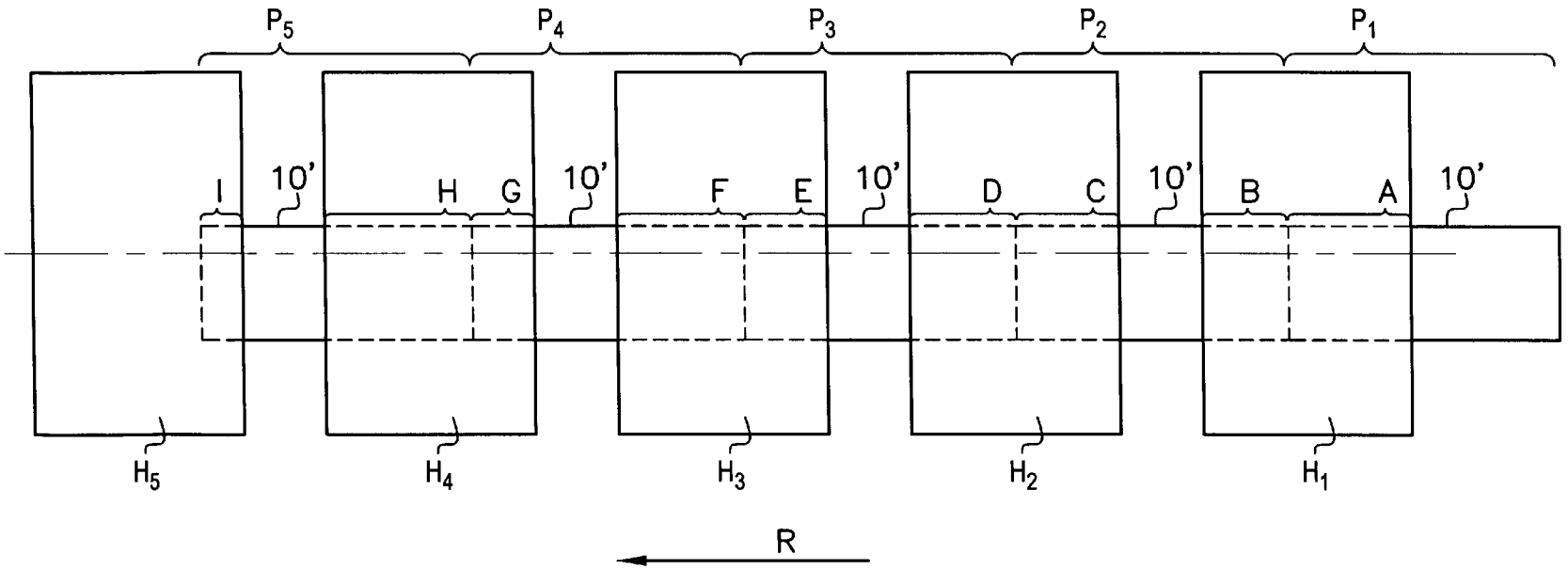
FIG. 10 shows an arrangement of heating assemblies according to one embodiment of this invention, and the progression of workpieces through the heating assemblies.

The workpieces 10' are heated as follows as they are fed through heating coil assemblies $H_1$–$H_5$ as discussed below and as illustrated in FIG. 10. When a workpiece 10' is in a first position $P_1$, the leading end portion of the workpiece is heated over length A within heating coil assembly $H_1$. The trailing end portion of this workpiece is outside of heating coil assembly, and is thus not heated when the workpiece is in position $P_1$. When a workpiece 10' is in a second position $P_2$, the leading end portion of this workpiece 10' is heated over length C within heating coil assembly $H_2$, while the trailing end portion is heated over length B within heating coil assembly $H_1$. When a workpiece 10' is a third position $P_3$, the leading end portion of this workpiece 10' is heated over length E within heating coil assembly $H_3$, while the trailing end portion is heated over length D within heating coil assembly $H_2$. When a workpiece 10' is in a fourth position $P_4$, the leading end portion of this workpiece 10' is heated over length G within heating coil assembly $H_4$, while the trailing end portion is heated over length F within heating coil assembly $H_3$. When a workpiece 10' is in a fifth position $P_5$, the leading end portion of this workpiece 10' is heated over length I within heating coil assembly $H_5$, while the trailing end portion is heated over length H within heating coil assembly $H_4$. When a workpiece 10' is in a position $P_f$, it is immediately removed as discussed above. Thus, as stated, the trailing end portion of each workpiece 10' is not heated in the heating coil assembly $H_5$.

As the workpieces are thus progressively heated, they progressively elongate slightly due to thermal expansion. Accordingly, in this embodiment, the heating coil assemblies $H_1$–$H_5$ may be spaced at slightly increasing distances in order to compensate for the thermal expansion. In other words, the space between heating coil assemblies $H_2$ and $H_3$ can be slightly longer than the space between heating coil assemblies $H_1$ and $H_2$, the space between heating coil assemblies $H_3$ and $H_4$ can be slightly longer than the space between $H_2$ and $H_3$, and the space between heating coil assemblies $H_4$ and $H_5$ can be slightly longer than the space between $H_3$ and $H_4$.

After passing through the plurality of heating coil assemblies $H_1$–$H_5$ and stopping at each of the positions described above, the leading end portion of each workpiece will have been heated over lengths A, C, E, G and I of heating coil assemblies $H_1$–$H_5$, respectively, for a total of five heating cycles. The trailing end portion of each workpiece 10' will have been heated over lengths B, D, F and H of heating coil assemblies $H_1$–$H_4$, respectively, for a total of four heating cycles. Therefore, the leading end portion of each workpiece 10' will be hotter than the trailing end portion. Further, the workpiece material will be cooler from the exterior surface to the core or central axis.

Figure 11C:
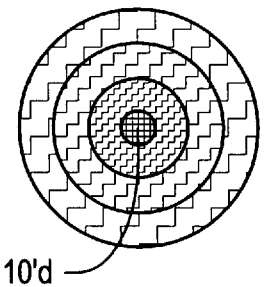
FIGS. 11A–11C are representative heating diagrams of a workpiece heated according to a method of certain embodiments of this invention.
Figure 11B:
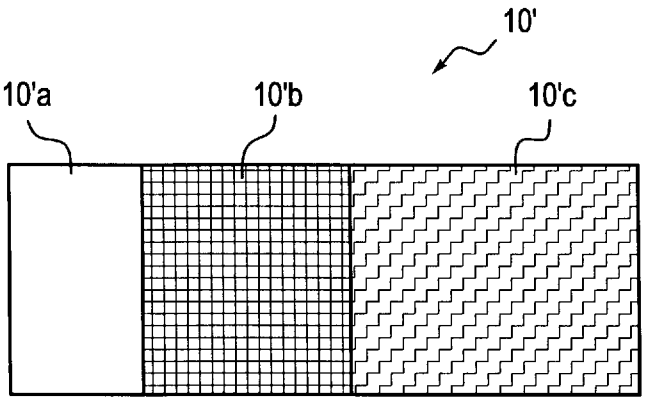
Figure 11A:
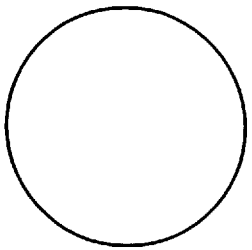

These heat gradients are graphically illustrated in FIGS. 11B and 11C. In this embodiment, the leading end portion 10'*a* of a workpiece 10' may be heated to from about 1900° F. to about 2000° F., while the trailing end portion 10'*c* of the workpiece may be heated to from about 1800° F. to about 1900° F. The central portion 10'*b* of the workpiece 10' may have a temperature somewhat lower than that of the ends 10'*a* and 10'. The radial center 10'*d* of the workpiece at the trailing end 10'*c* will be cooler than the exterior surface, and may have a temperature of from about 1500° F. to about 1600° F.

Although the described embodiment heats the leading end portions of the workpieces 10' in all five heating coil assemblies and heats the trailing end portions of the workpieces 10' only in heating coil assemblies $H_1$–$H_4$, variations are possible. For example, each workpiece 10' may be initially advanced to a point at which its trailing end portion is in heating coil assembly $H_1$ and its leading end portion is in heating coil assembly $H_2$ for the first heating cycle. Then, the workpieces 10' could be advanced in succession and, rather than immediately removing the leading workpiece 10' as it reaches the position $P_f$, that workpiece 10' could be left at position $P_f$ to undergo the heating cycle of heating coil assembly $H_5$. The leading end portion of that workpiece 10' would be outside heating coil assembly $H_5$ during this final heating cycle. In this scenario, the trailing end portions of the workpieces 10' would be hotter than the leading end portions.

While the invention has been described in conjunction with the specific embodiments described above, it is evident that many alternatives, modifications, variations and other embodiments will be apparent to those skilled in the art once provided this disclosure. Accordingly, the preferred embodiments of the invention as set forth above are intended to be illustrative and not limiting. Various changes can be made without departing from the spirit and scope of the invention.

What is claimed is:

1. A method of heating a workpiece, having first and second ends, for warm forging, the method comprising the steps of:

providing 1st through Nth heating assemblies; and advancing the workpiece through the heating assemblies in N time increments, wherein the first and second ends of the workpiece are not in the same heating assembly during each of the N time increments and are simultaneously in separate respective heating assemblies during at least one of the N time increments, and the second end being substantially unheated during at least one of the N time increments, such that the first end undergoes heating in N time increments, and the second end undergoes heating in M time increments, where M<N.

2. The method according to claim 1, further comprising the step of removing the workpiece from the heating immediately after the first end has been heated in the N time increments.

3. The method according to claim 1, further comprising the step of holding the workpiece stationary during each of the N time increments.

4. The method according to claim 3, wherein the step of holding comprises:

providing at least one holding finger that is movable between a clamp position at which the at least one holding finger engages the workpiece and a release position at which the at least one holding finger is not in engagement with the workpiece;

moving the at least one holding finger to the release position before each step of advancing the workpiece; and moving the at least one holding finger to the clamp position after the workpiece has moved a desired distance.

5. Apparatus for warm forging a part having a reduced end and an upset end during a single forging stroke, comprising:

a heating apparatus that heats ends of a workpiece such that a first end of the workpiece differs in temperature from a second end of the workpiece;

a forging punch-and-die combination configured to deform the heated workpiece into the part; and at least one holding finger activated by a pneumatic cylinder to hold the workpiece in at least one specified location with respect to the heating assemblies, the at least one holding finger being movable between a clamp position at which the workpiece is held stationary and a release position at which the workpiece can slide past the at least one holding finger.

6. Apparatus according to claim 5, wherein the heating apparatus comprises a plurality of heating assemblies.

7. Apparatus according to claim 6, further comprising a pusher member to push the workpiece through the heating assemblies in increments.

8. Apparatus according to claim 7, wherein the pusher member comprises a pushing rod activated by a pneumatic cylinder.

9. Apparatus according to claim 6, wherein the heating assemblies comprise heating coils.

10. Apparatus according to claim 9, wherein each of the heating coils is wound in a similar configuration.

11. Apparatus according to claim 9, wherein at least two of the heating coils are wound in configurations which mutually differ in at least one of i) coil spacing and ii) number of coils.

12. Apparatus according to claim 9, further comprising dummy coils connected in series with the heating coils.

13. Apparatus according to claim 5, further comprising a workpiece holding assembly to hold the workpiece in at least one specified location with respect to the heating assemblies.

14. Apparatus according to claim 8, wherein the workpiece holding assembly further comprises a resilient member between the at least one clamping finger and the pneumatic cylinder, the resilient member biasing the at least one clamping finger against the workpiece in the clamp position.

15. Apparatus for heating workpieces to be forged into parts, the apparatus comprising:

a plurality of spaced heating assemblies aligned in a row;

a tray member which extends through said plurality of heating assemblies, and slidably supports and laterally retains said workpieces, said tray member having at least one open portion that allows access to the workpieces from a direction transverse to a longitudinal axis of the workpieces; and a pusher assembly which is aligned with said heating assemblies and moves said workpieces through said heating assemblies;

wherein the heating assemblies are spaced such that when one end of one of the workpieces is in one of the heating assemblies, the other end of the one of the workpieces is in another of said heating assemblies.

16. Apparatus for heating workpieces according to claim 15, wherein said heating assemblies each comprise a heating coil inside of an insulated housing, each said housing having a passage to receive said tray member and said workpieces.

17. Apparatus for heating workpieces according to claim 15, wherein said heating assemblies are spaced apart a distance substantially equal to the length of said workpieces.

18. Apparatus for heating workpieces according to claim 15, wherein the pusher assembly advances the workpieces in increments through the plurality of heating assemblies, each increment being substantially equal to the length of the workpieces.

19. Apparatus for heating workpieces according to claim 15, wherein the pusher assembly includes a pneumatic cylinder which, when activated, engages and pushes the workpieces one increment along the tray.

20. Apparatus for heating workpieces according to claim 15, further comprising:

a workpiece holding assembly having engaging and disengaging positions;

wherein when said workpiece holding assembly is in the engaging position, the workpiece holding assembly engages the workpieces in the tray member and when said workpiece holding assembly is in the disengaging position, the workpiece holding assembly is not engaging the workpieces in the tray member.

21. Apparatus for heating workpieces according to claim 20, wherein the pusher assembly is activated while the workpiece holding assembly is in the disengaging position.

22. A process for heating workpieces to be used in metal forging to a desired temperature range, comprising:

providing a plurality of spaced heating assemblies in alignment, a tray member which extends through the plurality of heating assemblies and supports and laterally retains the workpieces, and a pusher member which engages and moves the workpieces along the tray through the heating assemblies, said tray member having at least one open portion that allows access to the workpieces from a direction transverse to a longitudinal axis of the workpieces;

placing said workpieces in said tray one at a time; and activating the pusher member at desired time increments after one of said workpieces is placed in the tray and moving the workpieces one distance increment along the tray.

23. A process for heating workpieces according to claim 22, wherein corresponding portions of the heating assemblies are spaced apart a distance substantially equal to the length of the workpieces.

24. A process for heating workpieces according to claim 22, wherein each workpiece has first and second ends, and the step of activating the pusher member results in one of the workpieces being positioned such that the first end is positioned in one of the heating assemblies and the second end is positioned in another of the heating assemblies; and wherein each activation of the pusher member moves the workpieces a distance substantially equal to the length of the workpieces.

25. A process for heating workpieces according to claim 22, wherein the workpieces have first and second ends; and said first ends are heated by the heating assemblies at least one time less than said second ends.

26. A process for heating workpieces according to claim 22, further comprising the step of providing a workpiece holding assembly having engaged and disengaged positions, wherein when the workpiece holding assembly is in the engaged position, the workpiece holding assembly engages the workpieces in the tray member, and when the workpiece holding assembly is in the disengaged position, the workpiece holding assembly does not engage the workpieces in the tray member.

27. A process for heating workpieces according to claim 22 wherein the heating assemblies include heating coils, and wherein the tray and the workpieces pass through the heating coils.

28. A method of heating a workpiece, having first and second portions, for warm forging, the method comprising the steps of:

providing 1st through Nth heating assemblies; and advancing the workpiece through the heating assemblies in N time increments wherein the first and second portions of the workpiece are not in the same heating assembly during each of the N time increments and are simultaneously in separate respective heating assemblies during at least one of the N time increments, and the second portion being substantially unheated during at least one of the N time increments, such that the first portion undergoes heating in N time increments and the second portion undergoes heating in M time increments, where M<N.

29. The method according to claim 28, further comprising the step of removing the workpiece from the heating assemblies immediately after the first portion has undergone heating in N time increments.

30. The method according to claim 28, further comprising the step of holding the workpiece stationary during each of the N time intervals.

31. The method according to claim 30, wherein the step of holding comprises:

providing at least one holding finger that is movable between a clamp position at which the at least one holding finger engages the workpiece and a release position at which the at least one holding finger is not in engagement with the workpiece;

moving the at least one holding finger to the release position before each step of advancing the workpiece; and moving the at least one holding finger to the clamp position after the workpiece has moved the desired distance.

* * * * *